United States Patent [19]

Carver

[11] 3,968,718

[45] July 13, 1976

[54] DRUM TYPE MUSICAL INSTRUMENT

[75] Inventor: Earl Randy Carver, Forest City, N.C.

[73] Assignee: The Raymond Lee Organization, Inc., a part interest

[22] Filed: Aug. 11, 1975

[21] Appl. No.: 603,769

[52] U.S. Cl. ..... 84/422 R
[51] Int. Cl.[2] ..... G10D 13/02
[58] Field of Search ..... 84/411, 422

[56] References Cited

UNITED STATES PATENTS

| | | | |
|---|---|---|---|
| 1,775,283 | 9/1930 | Juster | 84/422 |
| 2,845,830 | 8/1958 | Haviland | 84/422 |
| 3,677,128 | 7/1972 | Simpson | 84/422 |
| 3,742,806 | 7/1973 | Zalmer | 84/422 |

*Primary Examiner*—Lawrence R. Franklin

[57] ABSTRACT

First and second foot pedal actuated drums are disposed adjacent each other. Each drum is provided with a horizontal shaft having a drum beater secured thereto and extending at right angles, the beater being disposed adjacent a drum head. Flexible resilient spring means interconnect adjacent ends of the two shafts whereby actuation of the foot pedal of one drum causes the one drum to sound while the other drum is caused to sound without actuation of its foot pedal.

4 Claims, 3 Drawing Figures

DRUM TYPE MUSICAL INSTRUMENT

BACKGROUND OF THE INVENTION

Professional drummers find it desirable to use two foot pedal actuated base drums as well as foot pedal operated hi-hat cymbals. However, since a drummer can only actuate two foot pedal operated instruments at one time, one with each foot, the drummer is unable to create three drum effects or other musical innovations.

This invention overcomes these difficulties by enabling the drummer by actuating only one of the pedal actuated drums to cause the second drum to sound in unison with the first drum or slightly lingering or completely diliatory.

SUMMARY OF THE INVENTION

In accordance with the invention, first and second pedal actuated drums are disposed adjacent each other. Each drum is provided with a mechanism wherein depression of a spring loaded pedal causes a horizontal shaft to rotate and swing a drum beater secured to the shaft to strike an adjacent drum head, thus causing the drum to sound. As soon as the foot pressure is released, the mechanism causes the pedal shaft and beater to return to normal position. The drums are disposed in such manner that an end of the shaft of the first drum is disposed adjacent an end of the shaft of the second drum. A flexible resilient spring means or coupling member extends between these adjacent ends, with each end of the member being firmly connected to the corresponding end of the corresponding shaft. The member in its normal state has no internal torque or twist. However if one end of the member is rotated relative to the other through a selected arc before the member is connected to both shafts, an internal twist can be created. Due to this twist, the time period between the instant at which the first drum sounds and the time at which the rotation of the first shaft is transmitted through the member to the second shaft to cause the second drum to sound can be adjusted as desired. In any event, however, depression of only one pedal will cause both drums to sound in unison, or slightly lingering or completely diliatory, depending upon the amount of twist.

It should be understood that if the flexible resilient spring means is replaced by a non-resilient connector without spring action as for example, interconnecting the two shafts by a third shaft, the two drums cannot be made to sound slightly lingering or completely diliatory and thus the advantages of the invention cannot be obtained without the use of spring action and internal twist.

DETAILED DESCRIPTION OF PREFERRED EMBODIMENTS

Figure 1:
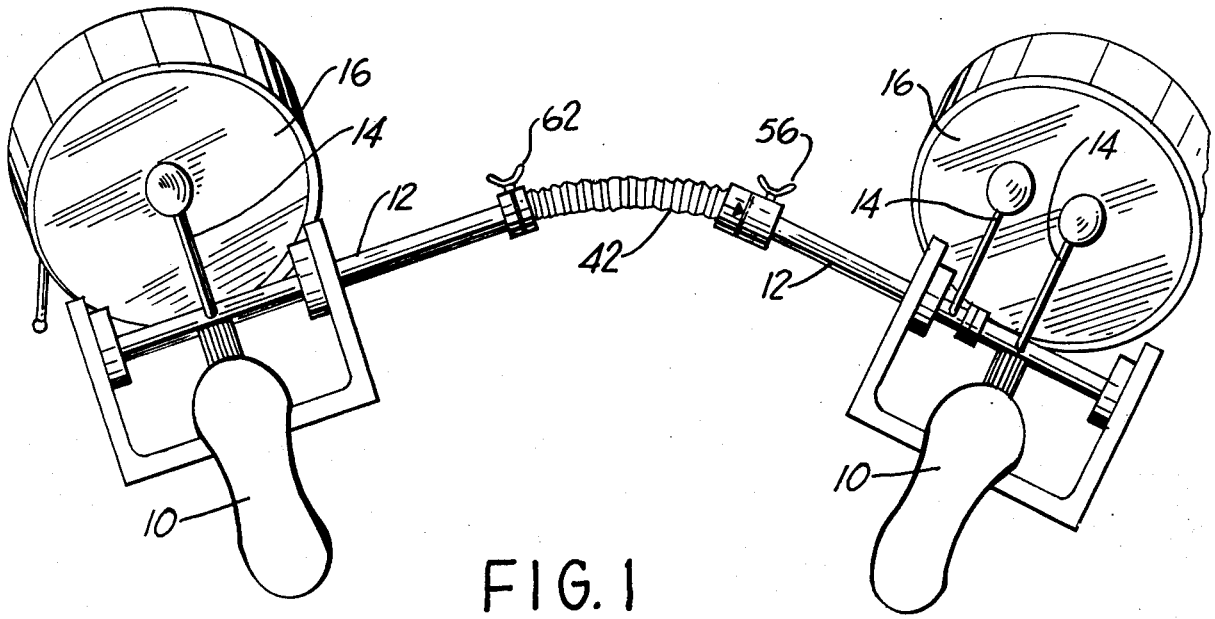
FIG. 1 is a perspective view of the invention.
Figure 2:
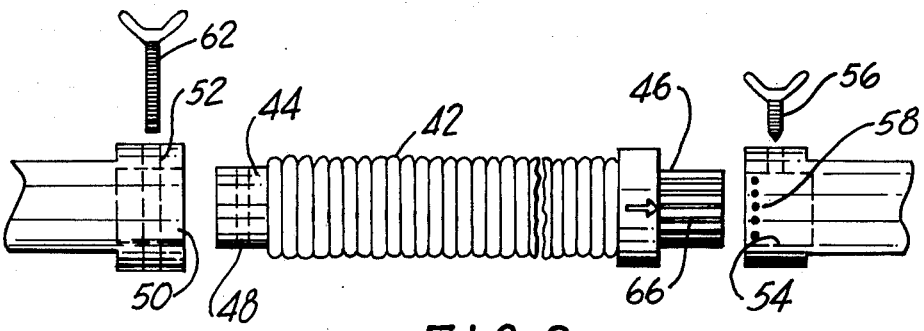
FIG. 2 is a detailed view of the spring means.
Figure 3:
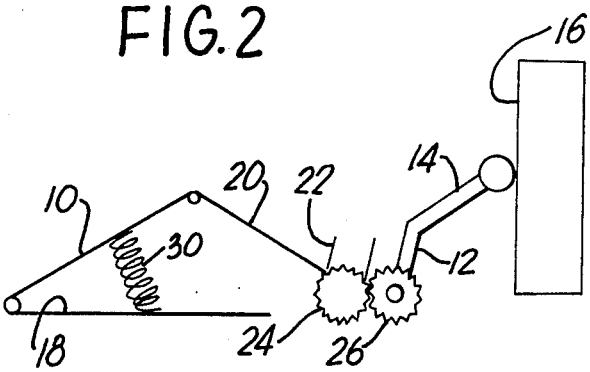
FIG. 3 is an illustrative schematic view of the foot pedal operated mechanism of the drum.

Referring now to FIGS. 1–3, many types of foot pedal controlled or actuated mechanisms for operating a drum are known. In all of them, depression of spring loaded foot pedal 10 causes horizontal shaft 12 to rotate moving drum beater 14, which is secured to the shaft 12 and extends at right angles thereto to engage drum head 16 and cause the drum to sound. The spring loading causes all parts to return to normal position when foot pressure is removed.

FIG. 3 shows pedal 10 pivotally secured at its lower end to horizontal frame 18 and pivotally secured at its upper end to one end of linkage 20. The linkage extends at right angles to horizontal shaft 22 and is secured thereto at its upper end. Shaft 22 carries gear 24 engaging gear 26 on shaft 12. The pedal is spring biased by spring 30. When the pedal is depressed, shaft 22 rotates counterclockwise, causing gear 14 to engage gear 26 to rotate shaft 12 clockwise and move the beater to sound the drum. Once foot pressure is removed, spring 30 raises the pedal whereby all parts return to normal position.

Thus there are two pedal actuated mechanisms for operating two drum heads. The two horizontal shafts 12 have adjacent ends with openings or central recesses 50 and 54 therein.

A coil spring 42 has shallow cylinders 44 and 46 welded to opposite ends. Cylinder 44 has a transverse bore 48 and is disposed in mating recess 50 in one adjacent end. This end has a bore 52 aligned with bore 48. The bores can be threaded and thumbscrew 62, can be disposed therein to hold one end of the flexible resilient spring means formed by the spring and cylinders in place in one shaft. Cylinder 46 can be fitted into recess 54 in the other shaft and held therein by thumbscrew 56. Axially disposed color strips 66 on cylinder 46 can be aligned with selected colored dots 58 on the outer surface of the shaft 12 having recess 54 whereby a desired amount of twist can be imparted to the spring before the connection between the shafts is completed. The musician by trial and error can calibrate various color strip-dot combinations whereby the delay between the sounding of the two drums desired by the musician can be obtained.

I claim:

1. A drum type musical instrument comprising:

first and second drums;

first and second pedal actuated beater means, each means having a mechanism with a horizontal shaft for controlling the position of a drum beater that will beat a corresponding one of the drums, the shafts being disposed end to end with one end of one shaft adjacent one end of the other shaft;

an elongated flexible resilient coil spring;

a first cylinder at one end of the spring;

a second cylinder at the other end of the spring;

first attachment means detachably securing the first cylinder to said one end of said one shaft; and second attachment means located at said one end of said other shaft for receiving the second cylinder and detachably securing the cylinder to said other shaft, the second attachment means having a recess within which the second cylinder can be rotated to a desired angular position relative to the first cylinder prior to being detachably secured to said other shaft, whereby the spring can be pre-tensioned to the degree desired.

2. The instrument of claim 1 wherein each attachment means includes a thumbscrew.

3. The instrument of claim 2 wherein the thumbscrew in the second attachment means bears against the second cylinder when the second cylinder is detachably secured to said other shaft.

4. The instrument of claim 3 wherein the thumbscrew in the first attachment means passes through a bore in the first cylinder.

* * * * *